US005988148A

United States Patent [19]

Astner et al.

[11] Patent Number: 5,988,148

[45] Date of Patent: Nov. 23, 1999

[54] MOUNTING ARRANGEMENT FOR AN EXHAUST GAS RECIRCULATION PIPE ON AN INTERNAL COMBUSTION ENGINE

[75] Inventors: Josef Astner, Stuttgart; Reinhard Krösche, Neckartenzlingen; Karl-Heinz Metzger, Schorndorf, all of Germany

[73] Assignee: Daimler Chrysler AG, Stuttgart, Germany

[21] Appl. No.: 09/009,028

[22] Filed: Jan. 20, 1998

[30] Foreign Application Priority Data

Jan. 21, 1997 [DE] Germany ..... 197 01 873

[51] Int. Cl.[6] ..... F02M 25/07

[52] U.S. Cl. ..... 123/568.11; 123/195 A; 123/568.18

[58] Field of Search ..... 123/568.11, 568.12, 123/568.17, 568.18, 90.38, 184.31, 195 A, 184.34, 184.38, 184.42, 184.47

[56] References Cited

U.S. PATENT DOCUMENTS

| | | | |
|---|---|---|---|
| 2,720,196 | 10/1955 | Wolf | 123/568.17 |
| 3,786,793 | 1/1974 | Bohls et al. | 123/568.18 |
| 4,909,036 | 3/1990 | Kimura | 123/568.17 |
| 5,168,838 | 12/1992 | Seike et al. | 123/184.31 |
| 5,309,886 | 5/1994 | Hitomi et al. | 123/568.12 |
| 5,666,930 | 9/1997 | Elder . | |

FOREIGN PATENT DOCUMENTS

| | | |
|---|---|---|
| 0 223 378 | 5/1987 | European Pat. Off. . |
| 0 565 410 | 10/1993 | European Pat. Off. . |
| 0 763 655 | 3/1997 | European Pat. Off. . |
| 35 29 543 | 2/1987 | Germany . |
| 40 17 074 | 11/1991 | Germany . |
| 195 07 354 | 9/1996 | Germany . |
| 195 48 024 | 12/1996 | Germany . |

*Primary Examiner*—Willis R. Wolfe
*Attorney, Agent, or Firm*—Klaus J. Bach

[57] ABSTRACT

In a mounting arrangement for an exhaust gas recirculation pipe in an internal combustion engine wherein the exhaust gas recirculation pipe extends from an exhaust gas pipe adjacent the engine to an intake duct and is supported on the engine in an intermediate area by a bracket, at least a part of the exhaust gas recirculation pipe and the bracket are formed as an integral building component so as to form a rigid support structure for the intake duct.

7 Claims, 1 Drawing Sheet

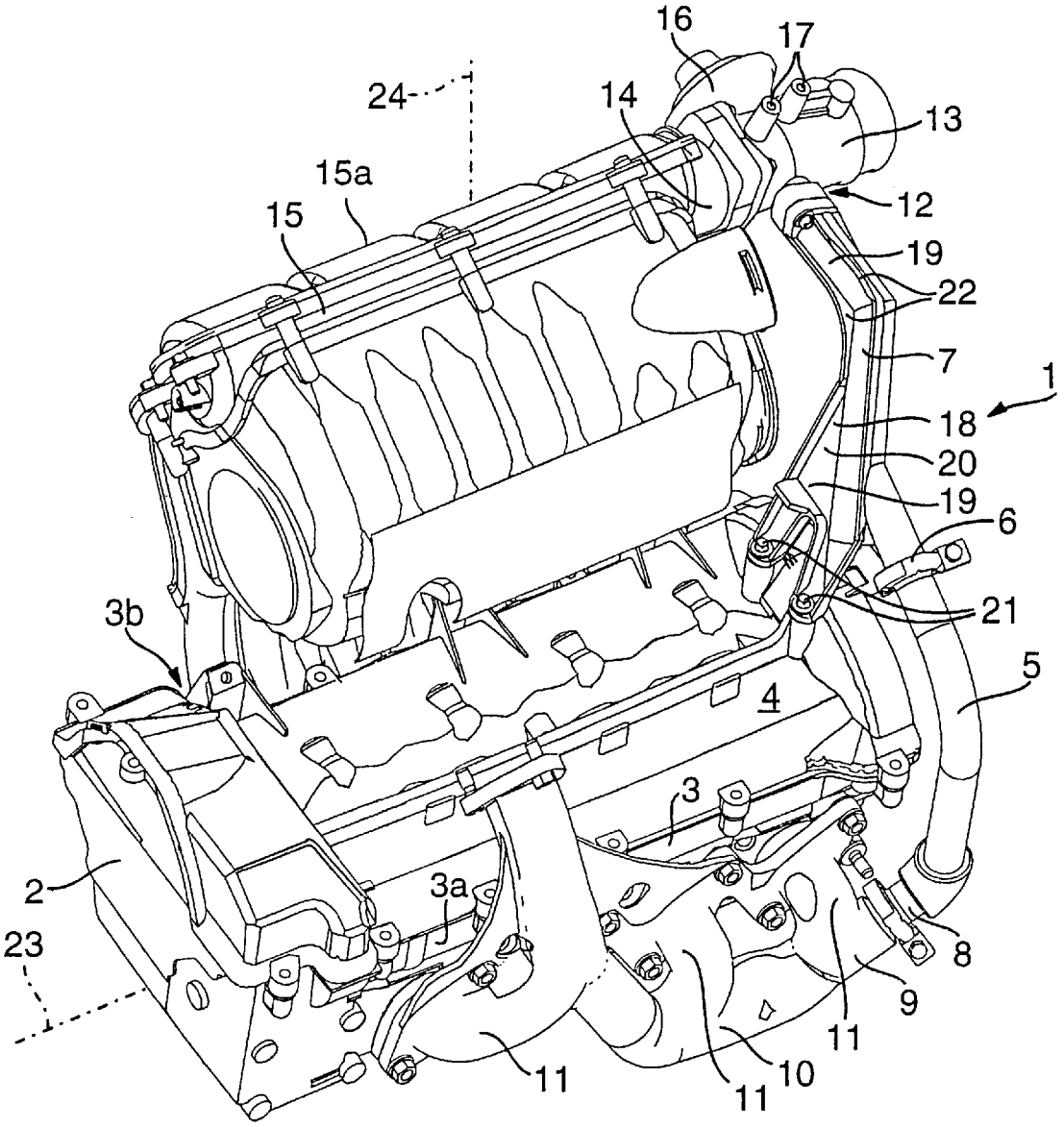
16
17
24
14
13
15a
12
15
19
22
7
1
18
20
19
6
3b
21
5
4
3
2
3a
23
8
9
11
10
11
11

MOUNTING ARRANGEMENT FOR AN EXHAUST GAS RECIRCULATION PIPE ON AN INTERNAL COMBUSTION ENGINE

BACKGROUND OF THE INVENTION

The invention relates to a mounting arrangement for an exhaust gas recirculation pipe on an internal combustion engine housing, wherein the exhaust gas recirculation pipe extends between the engine exhaust duct and the engine intake duct and is supported by an engine-mounted support structure.

DE 35 29 543 C2 discloses an engine support arrangement for an exhaust gas recirculation pipe wherein the recirculation pipe branches off an exhaust duct in the vicinity of the engine and leads to an intake duct of the engine. A support structure is provided by which the exhaust gas recirculation pipe and an exhaust gas recirculation control valve are supported on the cylinderhead of the internal combustion engine.

For general technical background information, reference is also made to DE 40 17 074 A1 and DE 195 07 354 A1.

It is the object of the present invention to provide a compact mounting arrangement for an exhaust recirculation pipe whereby the available space is utilized in an optimal manner and which is relatively inexpensive and can be installed easily.

SUMMARY OF THE INVENTION

In a mounting arrangement for an exhaust gas recirculation pipe in an internal combustion engine wherein the exhaust gas recirculation pipe extends from an exhaust gas pipe adjacent the engine to an intake duct and is supported on the engine in an intermediate area by a bracket, at least a part of the exhaust gas recirculation pipe and the bracket are formed as an integral building component so as to form a rigid support structure for the intake duct.

With the mounting arrangement according to the invention, wherein the support structure is an integral part of a portion of the exhaust gas recirculation pipe, little space and little additional material is required. With the elimination of separate support struts, the weight of the engine and also the manufacturing costs and the required mounting efforts for the support structure are reduced.

The building component does not only provide support for the exhaust gas recirculation pipe on the housing of the internal combustion engine, but additionally provides support for the mixing chamber and intake suction module. By connecting the building component to the cylinderhead cover and the mixing chamber, the exhaust gas recirculation line is supported and support is also provided for the suction module and the mixing chamber of the internal combustion engine. The building component also reduces the mounting requirements since only one component needs to be installed.

In a particularly advantageous embodiment of the invention, the building component includes axially extending reinforcement ribs adapted to counteract the forces normally effective on the component.

In order to simplify the mounting of the arrangement, the building component is attached to the cylinderhead by the bolts with which the cylinderhead cover is mounted on the cylinderhead of the internal combustion engine.

Further features and advantages of the invention will become apparent from the following description on the basis of the accompanying drawing.

BRIEF DESCRIPTION OF THE DRAWINGS

The sole FIGURE shows an engine with a mounting arrangement for the exhaust gas recirculation pipe.

DESCRIPTION OF A PREFERRED EMBODIMENT

The FIGURE shows the mounting arrangement of an exhaust gas recirculation pipe 1 on the engine housing 2 of a partially shown internal combustion engine which includes a cylinderhead 3 and a cylinderhead cover 4 mounted onto the cylinderhead 3.

The exhaust gas recirculation pipe 1 comprises a first pipe part 5 which is sealingly connected to a second pipe part 7 by a pipe clamp 6. The first pipe part 5 of the exhaust gas recirculation pipe 1 branches off an exhaust elbow 8 in the vicinity of the engine. The exhaust elbow 8 is in communication with a collection chamber 9 of an exhaust gas manifold 10 mounted onto the exhaust side 3*a* of the cylinderhead 3 by way of exhaust ducts 11. The second exhaust gas recirculation pipe part 7 which is connected the first pipe part 5 is in communication with the mixer housing 13 by way of a flange connection 12 and the mixer housing 13 is in communication with an intake pipe 14 of the internal combustion engine.

The intake pipe 14 is a part of an intake suction assembly 15 mounted onto the intake side of the internal combustion engine. The intake assembly 15 extends in the direction of the longitudinal axis 23 of the engine essentially over the full length of the cylinderhead 3 and essentially in parallel alignment with a plane extending through the axes of the engine cylinders, that is, the vertical engine axis 24.

The mixer housing 13 includes a vacuum actuator 16, which extends beyond the upper side 15*a* of the intake assembly 15 and which controls an exhaust gas recirculation valve arranged in the mixer housing 13. The mixer housing 13 has connections 17 for the connection of a second vacuum actuator which controls a throttle valve that is also disposed in the mixer housing 13 but is not shown in the drawing.

Along its length, the exhaust gas recirculation pipe 1 is supported on the engine by way of an engine-mounted support bracket 18, the second part of the exhaust gas recirculation pipe 1 being formed integrally with the bracket 18 to form a building component 19. The building component 19 is preferably a cast or molded structure provided with axially extending reinforcement ribs 22. Adjacent the bracket 18, the building component 19 includes an integrally formed mounting flange 20 by way of which it is mounted onto the cylinderhead 4 of the internal combustion engine by mounting bolts 21.

The engine, which is only partially shown, is installed in a vehicle in an inclined position, whereby the center of gravity of the intake assembly 15 is, when viewed in the direction of the vertical engine axis 24, on the side of, and above, the cylinderhead cover 4.

Because of the inclined position of installation of the engine in a vehicle, the intake assembly 15 and the mixer housing 13 are subjected to a moment which is counteracted by the bracket combined with the intake assembly 15.

In another embodiment of the invention, the mounting bolts 21 by which the bracket 18 or, respectively, the building component 19 is mounted to the cylinderhead cover 4 are used at the same time for mounting the cylinderhead cover 4 onto the cylinderhead 3 of the internal combustion engine so that no separate bolts are needed for that purpose.

What is claimed is:

1. A mounting arrangement for an exhaust gas recirculation pipe on an internal combustion engine, said exhaust gas recirculation pipe extending between an exhaust gas pipe adjacent the engine and an intake duct and including a support bracket supporting said exhaust recirculation pipe in an intermediate area thereof on said engine, said support bracket and at least a part of said exhaust gas recirculation pipe being an integral, rigid, building component forming a brace structure between said support bracket and said intake duct.

2. A mounting arrangement according to claim 1, wherein said exhaust gas recirculation pipe and support bracket building component is a casting.

3. A mounting arrangement according to claim 1, wherein said exhaust gas recirculation pipe and support bracket building component includes longitudinally extending reinforcement ribs.

4. A mounting arrangement according to claim 1, wherein said engine has a cylinderhead cover and said bracket is mounted on said cylinderhead cover.

5. A mounting arrangement according to claim 4, wherein said exhaust gas recirculation pipe and support bracket building component is mounted on said cylinderhead cover by mounting bolts by which, at the same time, said cylinderhead cover is mounted onto said cylinderhead.

6. A mounting arrangement according to claim 1, wherein, said exhaust gas pipe includes an elbow and said intake duct includes a mixer housing with an intake assembly and, at one end, said exhaust gas recirculation pipe is connected to an exhaust elbow and, at the other end to said mixer housing.

7. A mounting arrangement according to claim 6, wherein said exhaust gas recirculation pipe and support bracket building component form a rigid support for said mixer housing and intake assembly.

* * * * *